US008695266B2

(12) United States Patent
Moore et al.

(10) Patent No.: US 8,695,266 B2
(45) Date of Patent: Apr. 15, 2014

(54) REFERENCE BEAM GENERATING APPARATUS

(76) Inventors: Larry Moore, Cottonwood, AZ (US); Randy Allen Hoff, Arcadia, WI (US)

( * ) Notice: Subject to any disclaimer, the term of this patent is extended or adjusted under 35 U.S.C. 154(b) by 2094 days.

(21) Appl. No.: 11/317,647

(22) Filed: Dec. 22, 2005

(65) Prior Publication Data

US 2007/0144051 A1 Jun. 28, 2007

(51) Int. Cl.
*F41G 1/54* (2006.01)

(52) U.S. Cl.
USPC ..... 42/116; 356/249

(58) Field of Classification Search
USPC ..... 42/114, 115, 116, 117, 120, 121; 33/286, 290, 293, 297, 298; 356/247–255, 399
See application file for complete search history.

(56) References Cited

U.S. PATENT DOCUMENTS

| | | | | |
|---|---|---|---|---|
| 1,898,566 | A | | 2/1933 | Noel |
| 2,268,056 | A | | 12/1941 | Nelson et al. |
| 2,357,951 | A | | 9/1944 | Hale |
| 2,597,565 | A | | 5/1952 | Chandler et al. |
| 2,773,309 | A | | 12/1956 | Elliot |
| 2,780,882 | A | | 2/1957 | Temple |
| 2,826,848 | A | | 3/1958 | Davies |
| 3,112,567 | A | * | 12/1963 | Flanagan ..... 42/121 |
| 3,192,915 | A | | 7/1965 | Norris et al. |
| 3,510,965 | A | | 5/1970 | Rhea |
| 3,526,972 | A | | 9/1970 | Sumpf |
| 3,573,868 | A | | 4/1971 | Giannetti |
| 3,641,676 | A | | 2/1972 | Knutsen et al. |
| 3,645,635 | A | | 2/1972 | Steck |
| 3,801,205 | A | * | 4/1974 | Eggenschwyler ..... 356/138 |
| 3,914,873 | A | | 10/1975 | Elliott, Jr. et al. |
| 3,992,783 | A | | 11/1976 | Dunlap et al. |
| 3,995,376 | A | | 12/1976 | Kimble et al. |
| 4,079,534 | A | | 3/1978 | Snyder |
| 4,148,245 | A | | 4/1979 | Steffanus et al. |
| 4,156,981 | A | | 6/1979 | Lusk |
| 4,220,983 | A | | 9/1980 | Schroeder |
| 4,222,564 | A | | 9/1980 | Allen |
| 4,233,770 | A | | 11/1980 | de Filippis et al. |
| 4,234,911 | A | | 11/1980 | Faith |
| 4,295,289 | A | | 10/1981 | Snyder |

(Continued)

FOREIGN PATENT DOCUMENTS

| | | |
|---|---|---|
| EP | 1046877 | 10/2000 |
| FR | 862247 | 3/1941 |

OTHER PUBLICATIONS

Webpage print out from www.battenfeldtechnologies.com/wheeler referencing products from Wheeler Engineering. Webpage printout from http://secure.armorholdings.com/b-square/smarthtml/about.html referencing background on B-Square and their firearm accessories.

Webpage print out from http://secure.armorholdings.com/b-square/tools scope.html referencing scope and site tools offered by B-Square.

(Continued)

*Primary Examiner* — Benjamin P Lee
(74) *Attorney, Agent, or Firm* — Snell & Wilmer LLP

(57) ABSTRACT

The present invention provides an apparatus for aiding in the alignment of a scope of a firearm. The apparatus includes a light generation device and a level indicator. The light generation device is attachable to the firearm and is for generating a reference beam. The reference beam may be a horizontal, vertical, or cross-hair line beam. When the level indicator indicates a level state, the reference beam generated by the light generation device is also level. Typically, the level reference beam is projected against a flat surface and is used as a reference to line up the crosshairs of a scope attached to the firearm.

29 Claims, 12 Drawing Sheets

(56) References Cited

U.S. PATENT DOCUMENTS 4,305,091 A 12/1981 Cooper
4,348,828 A 9/1982 Snyder
4,481,561 A 11/1984 Lanning
4,488,369 A 12/1984 Van Note
4,541,191 A 9/1985 Morris et al.
4,567,810 A 2/1986 Preston
4,763,431 A 8/1988 Allan et al.
4,825,258 A 4/1989 Whitson
4,830,617 A 5/1989 Hancox et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,228,427 A 7/1993 Gardner, Jr.
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A * 11/1994 Lee ..... 33/290
5,373,644 A 12/1994 De Paoli
5,375,362 A 12/1994 McGarry et al.
5,388,335 A 2/1995 Jung
5,392,550 A 2/1995 Moore et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A * 10/1996 Breda ..... 33/290
5,581,898 A 12/1996 Thummel
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,289,624 B1 9/2001 Hughes et al.
6,295,753 B1 * 10/2001 Thummel ..... 42/116
6,301,046 B1 10/2001 Tai et al.
6,318,228 B1 11/2001 Thompson
6,345,464 B1 2/2002 Kim et al.
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,782,789 B2 8/2004 McNulty
6,854,205 B2 2/2005 Wikle et al.
6,931,775 B2 8/2005 Burnett
6,935,864 B2 8/2005 Shechter et al.
6,966,775 B1 11/2005 Kendir et al.
7,032,342 B2 4/2006 Pikielny
7,049,575 B2 5/2006 Hotelling
7,111,424 B1 9/2006 Moody et al.
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
RE40,429 E 7/2008 Oliver et al.
D578,599 S 10/2008 Cheng

(56) References Cited

U.S. PATENT DOCUMENTS

| | | | |
|---|---|---|---|
| 7,441,364 | B2 | 10/2008 | Rogers et al. |
| 7,453,918 | B2 | 11/2008 | Laughman et al. |
| 7,454,858 | B2 | 11/2008 | Griffin |
| 7,464,495 | B2 | 12/2008 | Cahill |
| 7,472,830 | B2 | 1/2009 | Danielson |
| 7,490,429 | B2 | 2/2009 | Moody et al. |
| 7,578,089 | B1 | 8/2009 | Griffin |
| 7,584,569 | B2 | 9/2009 | Kalli |
| 7,591,098 | B2 | 9/2009 | Matthews et al. |
| D602,109 | S | 10/2009 | Cerovic et al. |
| 7,603,997 | B2 | 10/2009 | Hensel et al. |
| D603,478 | S | 11/2009 | Hughes |
| 7,624,528 | B1 | 12/2009 | Bell et al. |
| 7,627,976 | B1 | 12/2009 | Olson |
| 7,644,530 | B2 | 1/2010 | Scherpf |
| 7,652,216 | B2 | 1/2010 | Sharrah et al. |
| D612,756 | S | 3/2010 | D'Amelio et al. |
| D612,757 | S | 3/2010 | D'Amelio et al. |
| 7,674,003 | B2 | 3/2010 | Sharrah et al. |
| 7,676,975 | B2 | 3/2010 | Phillips et al. |
| 7,685,756 | B2 | 3/2010 | Moody et al. |
| 7,698,847 | B2 | 4/2010 | Griffin |
| 7,703,719 | B1 | 4/2010 | Bell et al. |
| 7,712,241 | B2 | 5/2010 | Teetzel et al. |
| D616,957 | S | 6/2010 | Rievley et al. |
| 7,726,059 | B2 | 6/2010 | Pikielny |
| 7,726,061 | B1 | 6/2010 | Thummel |
| 7,730,820 | B2 | 6/2010 | Vice et al. |
| 7,743,546 | B2 | 6/2010 | Keng |
| 7,743,547 | B2 | 6/2010 | Houde-Walter |
| 7,753,549 | B2 | 7/2010 | Solinsky et al. |
| 7,771,077 | B2 | 8/2010 | Miller |
| 7,797,843 | B1 | 9/2010 | Scott et al. |
| 7,805,876 | B1 | 10/2010 | Danielson et al. |
| 7,818,910 | B2 | 10/2010 | Young |
| 7,841,120 | B2 | 11/2010 | Teetzel et al. |
| 7,880,100 | B2 | 2/2011 | Sharrah et al. |
| 7,900,390 | B2 | 3/2011 | Moody et al. |
| 7,913,439 | B2 | 3/2011 | Whaley |
| D636,049 | S | 4/2011 | Hughes et al. |
| D636,837 | S | 4/2011 | Hughes et al. |
| 7,921,591 | B1 | 4/2011 | Adcock |
| 7,926,218 | B2 | 4/2011 | Matthews et al. |
| 8,028,460 | B2 | 10/2011 | Williams |
| 8,028,461 | B2 | 10/2011 | NuDyke |
| 8,050,307 | B2 | 11/2011 | Day et al. |
| 8,056,277 | B2 | 11/2011 | Griffin |
| 8,093,992 | B2 | 1/2012 | Jancic et al. |
| 8,104,220 | B2 | 1/2012 | Cobb |
| D653,798 | S | 2/2012 | Janice et al. |
| 8,109,024 | B2 | 2/2012 | Abst |
| 8,110,760 | B2 | 2/2012 | Sharrah et al. |
| 8,136,284 | B2 | 3/2012 | Moody et al. |
| 8,141,288 | B2 | 3/2012 | Dodd et al. |
| 8,146,282 | B2 | 4/2012 | Cabahug et al. |
| 8,151,504 | B1 | 4/2012 | Aiston |
| 8,151,505 | B2 | 4/2012 | Thompson |
| 8,166,694 | B2 | 5/2012 | Swan |
| 8,172,139 | B1 | 5/2012 | McDonald et al. |
| D661,366 | S | 6/2012 | Zusman |
| 8,196,328 | B2 | 6/2012 | Simpkins |
| 8,215,047 | B2 | 7/2012 | Ash et al. |
| 8,225,542 | B2 | 7/2012 | Houde-Walter |
| 8,225,543 | B2 | 7/2012 | Moody et al. |
| 8,245,428 | B2 | 8/2012 | Griffin |
| 8,245,434 | B2 | 8/2012 | Hogg et al. |
| 8,256,154 | B2 | 9/2012 | Danielson et al. |
| 8,258,416 | B2 | 9/2012 | Sharrah et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |
| D669,959 | S | 10/2012 | Johnston et al. |
| D670,785 | S | 11/2012 | Fitzpatrick et al. |
| D672,005 | S | 12/2012 | Hedeen et al. |
| 8,322,064 | B2 | 12/2012 | Cabahug et al. |
| 8,335,413 | B2 | 12/2012 | Dromaretsky et al. |
| D674,861 | S | 1/2013 | Johnston et al. |
| D674,862 | S | 1/2013 | Johnston et al. |
| D675,281 | S | 1/2013 | Speroni |
| 8,341,868 | B2 | 1/2013 | Zusman |
| 8,347,541 | B1 | 1/2013 | Thompson |
| 8,360,598 | B2 | 1/2013 | Sharrah et al. |
| D676,097 | S | 2/2013 | Izumi |
| 8,365,456 | B1 | 2/2013 | Shepard |
| D677,433 | S | 3/2013 | Swan et al. |
| D678,976 | S | 3/2013 | Pittman |
| 8,387,294 | B2 | 3/2013 | Bolden |
| 8,393,104 | B1 | 3/2013 | Moody et al. |
| 8,393,105 | B1 | 3/2013 | Thummel |
| 8,397,418 | B2 | 3/2013 | Cabahug et al. |
| 8,402,683 | B2 | 3/2013 | Cabahug et al. |
| 8,413,362 | B2 | 4/2013 | Houde-Walter |
| 8,443,539 | B2 | 5/2013 | Cabahug et al. |
| 8,444,291 | B2 | 5/2013 | Swan et al. |
| 8,448,368 | B2 | 5/2013 | Cabahug et al. |
| 8,458,944 | B2 | 6/2013 | Houde-Walter |
| 8,467,430 | B2 | 6/2013 | Caffey et al. |
| 8,468,930 | B1 | 6/2013 | Bell |
| D687,120 | S | 7/2013 | Hughes et al. |
| 8,480,329 | B2 | 7/2013 | Fluhr et al. |
| 8,484,882 | B2 | 7/2013 | Haley et al. |
| 8,485,686 | B2 | 7/2013 | Swan et al. |
| 8,516,731 | B2 | 8/2013 | Cabahug et al. |
| 2002/0073561 | A1* | 6/2002 | Liao ..... 33/286 |
| 2002/0134000 | A1* | 9/2002 | Varshneya et al. ..... 42/115 |
| 2002/0194767 | A1 | 12/2002 | Houde-Walter et al. |
| 2003/0003424 | A1 | 1/2003 | Shechter et al. |
| 2003/0180692 | A1 | 9/2003 | Skala et al. |
| 2003/0196366 | A1 | 10/2003 | Beretta |
| 2004/0010956 | A1 | 1/2004 | Bubits |
| 2005/0044736 | A1* | 3/2005 | Liao ..... 33/286 |
| 2005/0188588 | A1 | 9/2005 | Keng |
| 2005/0241209 | A1 | 11/2005 | Staley |
| 2005/0257415 | A1 | 11/2005 | Solinsky et al. |
| 2005/0268519 | A1 | 12/2005 | Pikielny |
| 2006/0162225 | A1 | 7/2006 | Danielson |
| 2006/0191183 | A1 | 8/2006 | Griffin |
| 2007/0190495 | A1 | 8/2007 | Kendir et al. |
| 2007/0271832 | A1 | 11/2007 | Griffin |
| 2008/0000133 | A1 | 1/2008 | Solinsky et al. |
| 2008/0060248 | A1 | 3/2008 | Pine et al. |
| 2008/0134562 | A1 | 6/2008 | Teetzel |
| 2009/0013580 | A1 | 1/2009 | Houde-Walter |
| 2009/0013581 | A1 | 1/2009 | LoRocco |
| 2009/0178325 | A1 | 7/2009 | Veilleux |
| 2009/0293335 | A1 | 12/2009 | Danielson |
| 2010/0058640 | A1 | 3/2010 | Moore et al. |
| 2010/0162610 | A1 | 7/2010 | Moore et al. |
| 2010/0175297 | A1 | 7/2010 | Speroni |
| 2010/0229448 | A1 | 9/2010 | Houde-Walter |
| 2011/0047850 | A1 | 3/2011 | Rievley et al. |
| 2011/0061283 | A1 | 3/2011 | Cavallo |
| 2011/0162249 | A1 | 7/2011 | Woodmansee et al. |
| 2012/0047787 | A1 | 3/2012 | Curry |
| 2012/0055061 | A1 | 3/2012 | Hartley et al. |
| 2012/0124885 | A1 | 5/2012 | Caulk et al. |
| 2013/0185982 | A1 | 7/2013 | Hilbourne et al. |

OTHER PUBLICATIONS

Webpage print out from www.blackanddecker.com/laserline/lasers.aspx referencing the Black & Decker's Auto-Leveling Lasers.

Webpage print out from www.laserlevel.co.uk/newsite.index.asp referencing the laser devices available on the Laserlevel Online Store.

Webpage print out from http://airgunexpress.com/ Accessories/referencing various level devices.

Webpage print out from www.battenfeldtechnologies.com/113088.html referencing a level device.

*Shooting Illustrated*, "Update on the .25 SAUM" Jul. 2005 pp. 14-15.

* cited by examiner

REFERENCE BEAM GENERATING APPARATUS

DESCRIPTION OF THE INVENTION

Field of the Invention

The present invention relates to an apparatus for aiding in the alignment of a scope of a firearm.

SUMMARY OF THE INVENTION

The present invention provides an apparatus for aiding in the alignment of a scope of a firearm. The apparatus includes a light generation device and a level indicator. The light generation device is attachable to the firearm and generates a reference beam. The reference beam may be a horizontal, vertical, or cross-hair line beam. The apparatus is constructed so that when the level indicator indicates a level state, the reference beam generated by the light generation device is also level. Typically, the level reference beam is projected against a flat surface and is used as a reference to line up the crosshairs of a scope attached to the firearm.

The light generation device may include a bore connector and a light generator. The bore connector has two ends, one of which is attachable to the firearm. Typically, the bore connector is inserted into the bore of the firearm. The light generator is attached to the other end of the bore connector. The light generator generates the reference beam. Typically, the light generator will include a laser, but may be any type of light generator capable of producing a reference beam. The light generator may also include a reference beam lens. In this case, the reference beam is generated by passing light produced by the light generator through the reference beam lens.

The level indicator may be mounted on or in a housing that contains the reference beam lens. The level indicator and reference beam lens are situated in the housing such that a reference beam generated from light passing through the reference beam lens is level when the level indicator shows a level state. In order to coordinate the level indicator with the reference beam lens, the housing may contain a physical guide that controls the orientation of the lens when placed in the housing. In this way, a more repeatable and accurate orientation of the lens can be achieved.

It is to be understood that the descriptions of this invention herein are exemplary and explanatory only and are not restrictive of the invention as claimed.

DESCRIPTION OF THE EMBODIMENTS

Reference will now be made in detail to the present exemplary embodiments of the invention, examples of which are illustrated in the accompanying drawings.

The invention provides an apparatus for aiding in the alignment of a scope of a firearm. Typically, the apparatus is attachable to a firearm. The apparatus generates one or more visible reference beams and utilizes a level indicator to indicate when the reference beam is level. That is, if the level indicator indicates a level state, the reference beam will be level. The one or more level reference beams may then be used as an aid in leveling and/or aligning the scope of the firearm (e.g., an optical scope).

Figure 1:
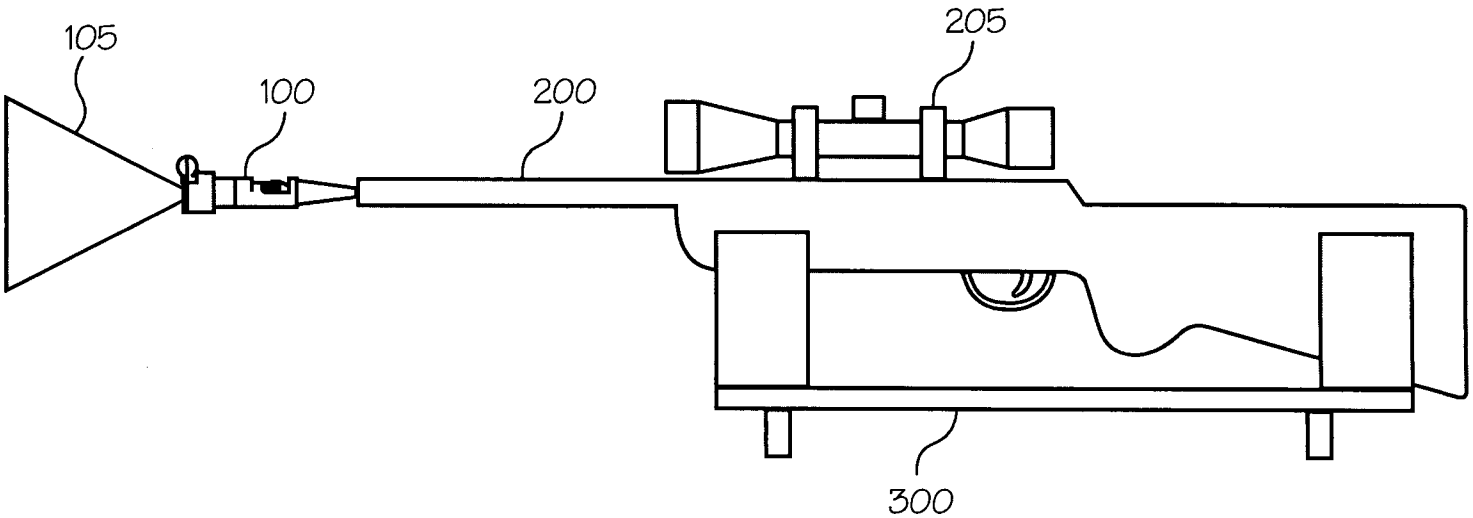
FIG. 1 depicts an embodiment of the inventive apparatus in a typical operating environment.

FIG. 1 depicts one embodiment of the inventive apparatus in a typical operating environment. Apparatus 100 produces one or more visible reference beam(s) 105 that may be projected onto a surface (e.g., a wall). Reference beam(s) 105 may be of any shape or size suitable for use as a reference to aid in the alignment of an optical scope. Preferably, reference beam(s) 105 is one or more line-shaped beams. However, reference beam(s) 105 may be made up of one ore more series of dots, dashes, or a combination of both, that form one or more lines (e.g., parallel lines) when taken together. When in use, apparatus 100 is typically mounted to firearm 200. Preferably, apparatus 100 is mounted to the firearm by inserting it into the bore of the firearm.

When apparatus 100 is activated, reference beam(s) 105 is projected against a surface. Preferably, reference beam(s) 105 is projected substantially along the longitudinal axis of the firearm barrel so as to simulate the flight path of a projectile. The apparatus is then adjusted so that the reference beam(s) is level. The structures and methods for producing a level reference beam(s) and verifying that the reference beam is level will be discussed in more detail with reference to FIG. 2. Once the reference beam(s) is level, scope 205 (e.g., an optical scope) may be aligned. To prevent movement of the scope and firearm during scope alignment, the firearm is preferably securely mounted in bracket 300.

Figure 2:
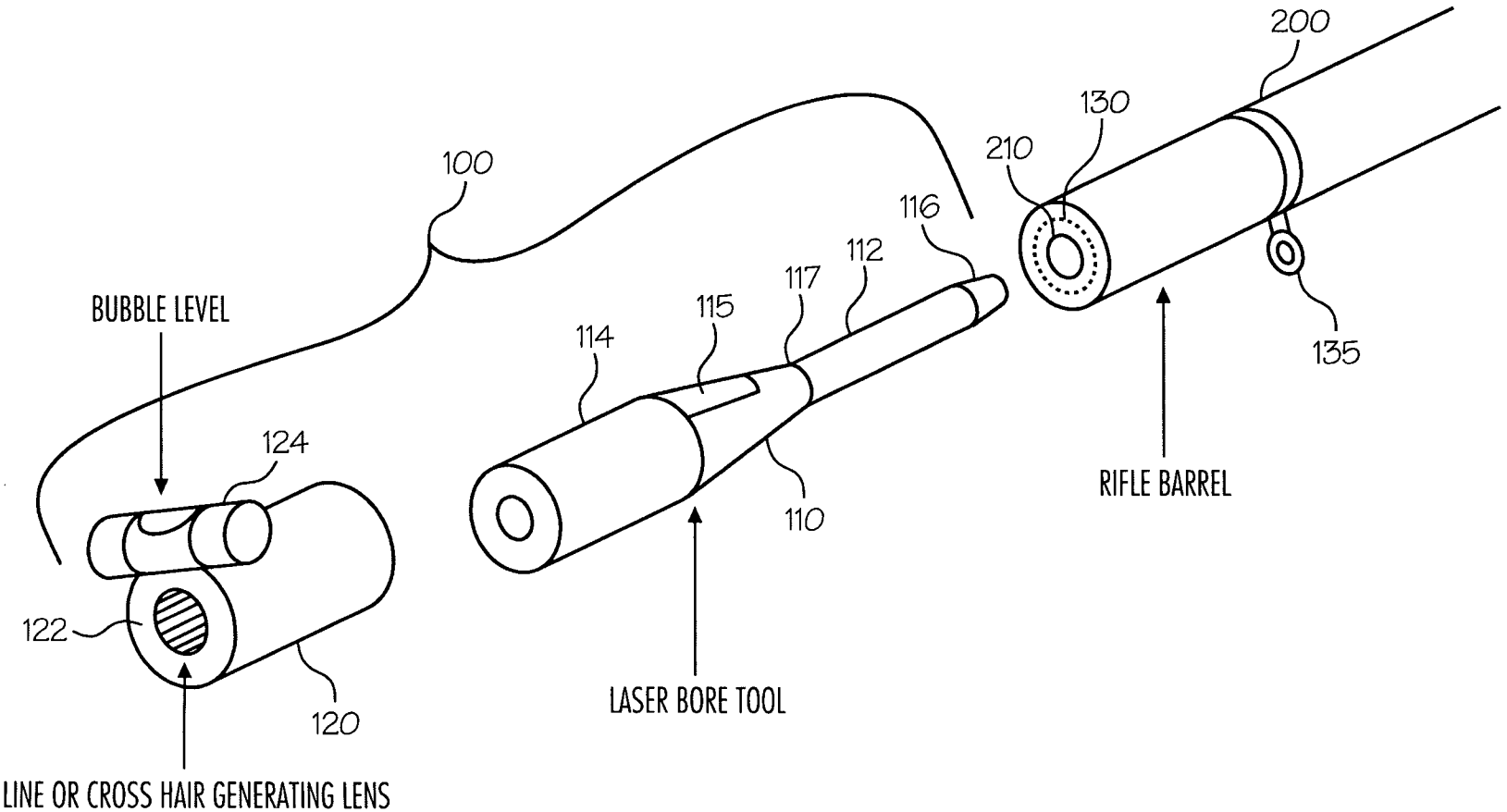
FIG. 2 depicts an exploded view of the inventive apparatus according to one embodiment of the invention.

FIG. 2 depicts an exploded view of apparatus 100 according to one embodiment of the invention. Apparatus 100 includes a light generation device 110 and a level indicator 124. Light generation device 110 may be any device capable of producing one or more beams of light (i.e., reference beam(s) 105) that are visible when projected on a surface. Preferably, reference beam(s) 105 is a line-shaped beam. Reference beam(s) 105 may be horizontal, vertical, or cross-hair in shape, however any shape or size of reference beam suitable as a reference for aligning a scope may be employed.

Level indicator 124 operates in conjunction with light generation device 110 such that when level indicator 124 indicates a level state, the reference beam(s) 105 generated by light generation device 110 is also level. A level state is defined as 0 degrees from a horizontal plane for a horizontal line-shaped reference beam and 90 degrees from the horizontal plane for a vertical line-shaped reference beam. Any type of level indicator may be employed. As shown in FIG. 2, level indicator 124 is a bubble-type level (spirit level) and is mounted on a housing 120 that is separate from light generation device 110. However, level indicator 124 may be mounted anywhere on apparatus 100 so long as the level indicator indicates a level state when reference beam(s) 105 is level. In addition, level indicator 124 may be completely separate from the light generator. For example, light generator 110 may include an electronic level detector that wirelessly transmits a signal to a separate level indicator.

Light generation device 110 may include a light generator 114 and a bore connector 112. Bore connector 112 preferably has two ends. First end 116 of the bore connector is insertable into bore 210 of firearm 200. It may be advantageous to utilize a bore adapter 130 to accommodate firearm bores of varying sizes. In this case, bore adapter 130 is inserted into firearm bore 210 and first end 116 is then inserted into the bore adapter. In addition, bore connector 112 may be inserted into a bore connector receptacle 135 that may be attached to the firearm. Once inserted into the firearm bore or bore connector receptacle, light generation device 110 should be able to rotate freely around the longitudinal axis of the firearm barrel.

Second end 117 of bore connector 112 is connected to light generator 114. Light generator 114 may be any device capable of generating a reference beam. In addition, light generator 114 may also be a light source that requires an additional lens to generate a reference beam. For instance, light generator 114 may be a laser that produces a reference beam by projecting laser light through an additional lens, such as reference beam lens 122. Such lasers are typically battery powered and activated with a switch 115. For example, light generator 114 may be a solid-state laser module. The combination of such a laser and a bore connector, without a reference beam lens, is often called a "Laser Bore Sighter."

To make use of such Laser Bore Sighters, one embodiment of the invention provides a reference beam lens 122 contained within a housing 120. As discussed above, level indicator 124 may also be mounted on or in housing 120. In addition, housing 120 may be constructed to contain both reference beam lens 122 and level indicator 124 in common. Reference beam lens 122 and level indicator 124 are situated such that a reference beam generated by passing light through the reference beam lens (such as a laser beam from a Laser Bore Sighter) is level when the level indicator indicates a level state. Reference beam lens 122 may be any lens capable of producing a reference beam suitable as a reference for adjusting the scope of a firearm. Preferably, the reference beam lens is a line-generating lens.

Figure 3:
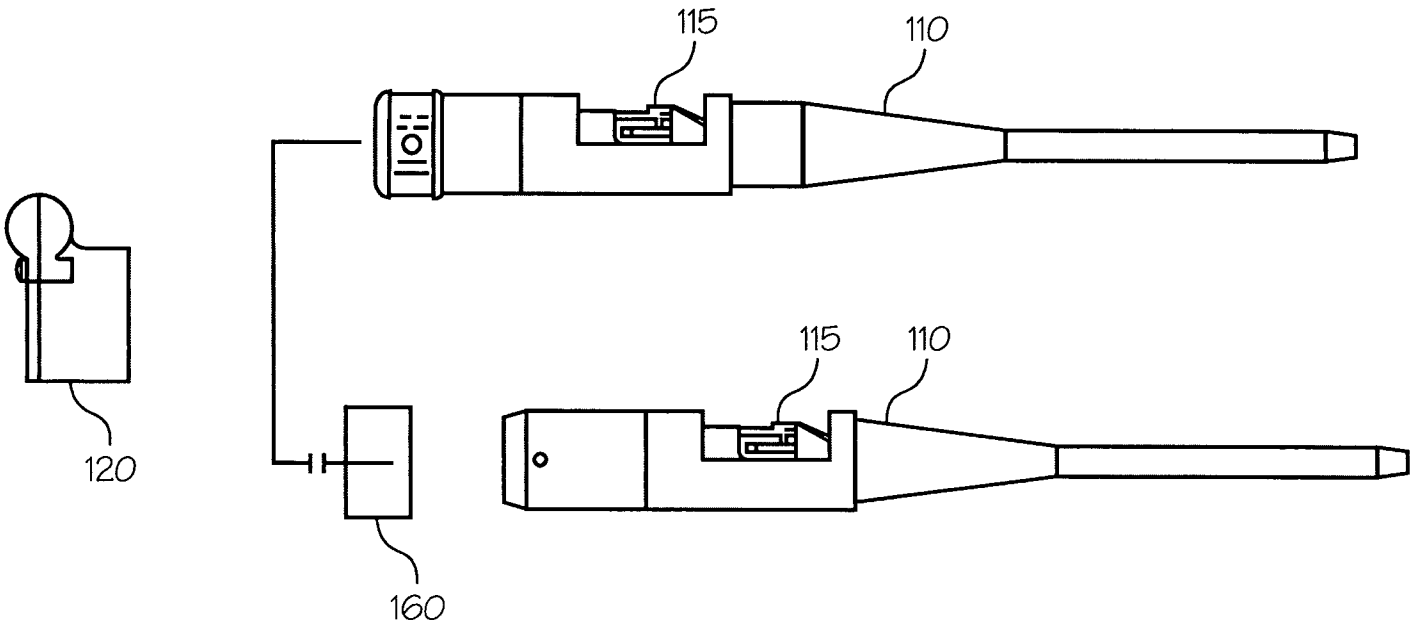
FIG. 3 depicts two embodiments of structures for the assembly of the reference beam lens to the light generator.
Figure 4:
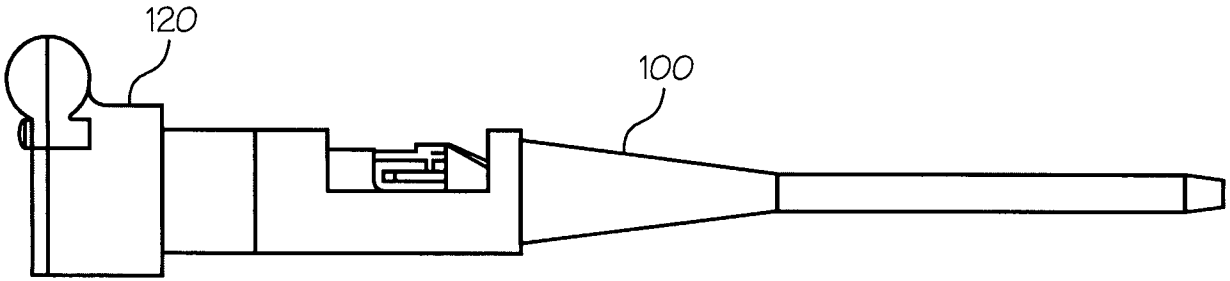
FIG. 4 depicts an assembled apparatus according to one embodiment of the invention.

FIG. 3 depicts two structures for the assembly of the reference beam lens to a light generation device. As discussed above, conventional Laser Bore Sighters may be utilized in conjunction with reference beam lens 122 to form light generation device 110. Housing 120, containing reference beam lens 122 and level indicator 124, can be mounted on light generation device 110 in any fashion. The housing is preferably structured to provide a "press" fit onto the light generation device. For some conventional Laser Bore Sighters a sleeve adapter 160 that fits around the Laser Bore Sighter may be used to provide a more secure fit. FIG. 4 depicts one embodiment of an assembled reference beam generating apparatus 100 utilizing housing 120, reference beam lens 122, and level indicator 124. As shown in FIG. 4, housing 120 is attached to a Laser Bore Sighter.

Figure 5:
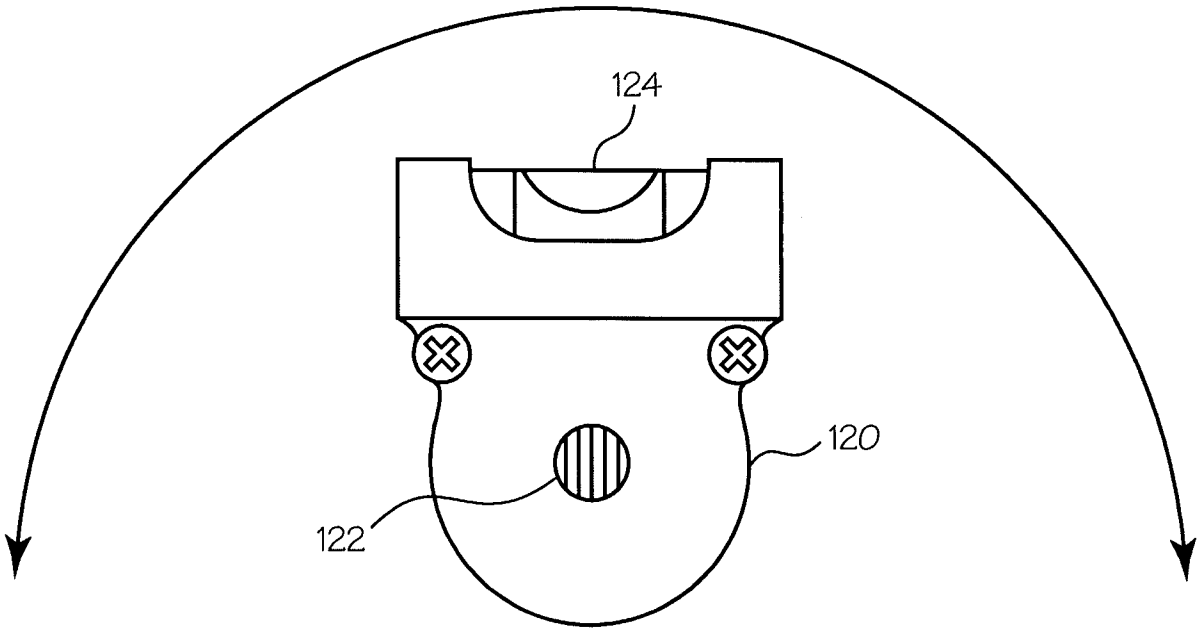
FIG. 5 depicts an end view of the reference beam lens, level indicator, and housing according to one embodiment of the invention.

FIG. 5 depicts an end view of one embodiment of housing 120 including reference beam lens 122 and level indicator 124. When the apparatus 100 is inserted into firearm 200, the fit should allow for rotation about the longitudinal access of the firearm barrel. The apparatus 100 may then be rotated either clockwise or counter-clockwise until level indicator 124 indicates a level state. When level indicator 124 indicates a levels state, a level reference beam will be generated when light generator 114 is activated. In embodiments where both a reference generation lens and level indicator are included in the same housing, a level reference beam may be generated by either rotating the entire apparatus 100 or by rotating just the housing 120 containing the reference beam lens and level indicator.

FIGS. 6 to 9 depict how an optical scope of firearm may be adjusted with the aid of one embodiment of the inventive apparatus. Initially, first end 116 of the bore connector is placed in the bore of a firearm. Preferably, the firearm is secured in a stable position, such as by bracket 300 (see FIG. 1). Next, the light generation device is activated and the reference beam is generated. For example, when using a Laser Bore Sighter, switch 115 would be turned on to activate the laser. Next, the apparatus 100 is rotated until the level indicator indicates a level state. Finally, the scope is manually adjusted so that its crosshairs line up with the generated reference beam.

Figure 6:
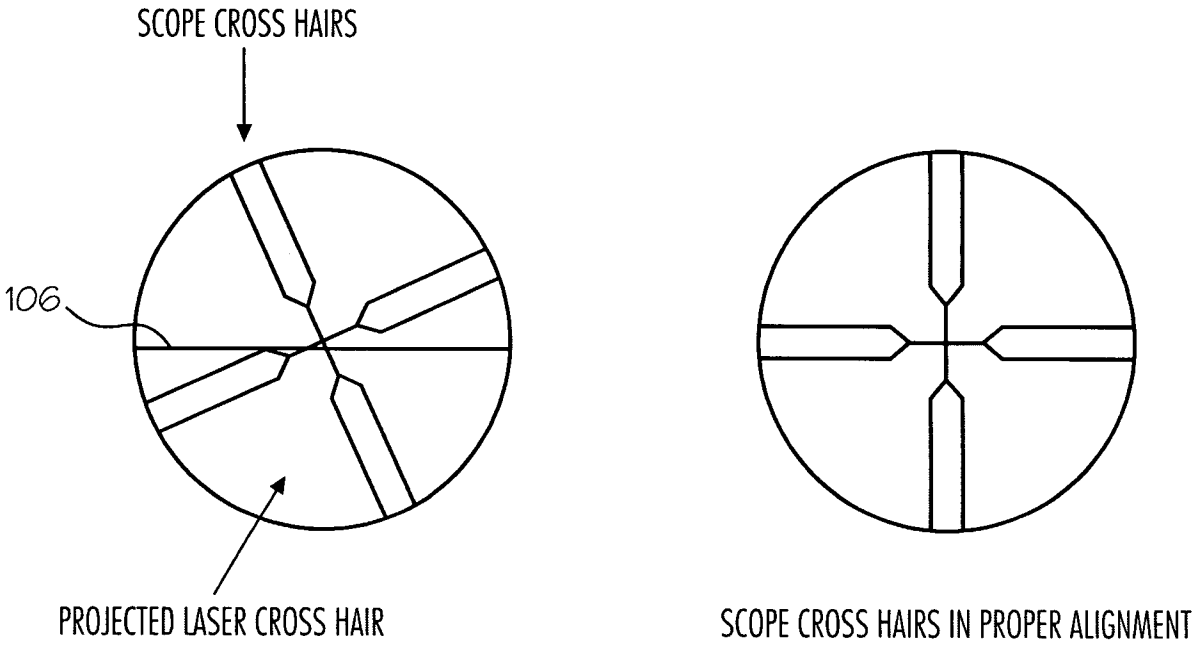
FIG. 6 depicts a view of a horizontal reference beam from an optical scope.

FIG. 6 depicts a view of a horizontal reference beam from an optical scope. Once the level indicator indicates a level state, the cross-hairs of the optical scope may be adjusted to line up with horizontal beam 106.

Figure 7:
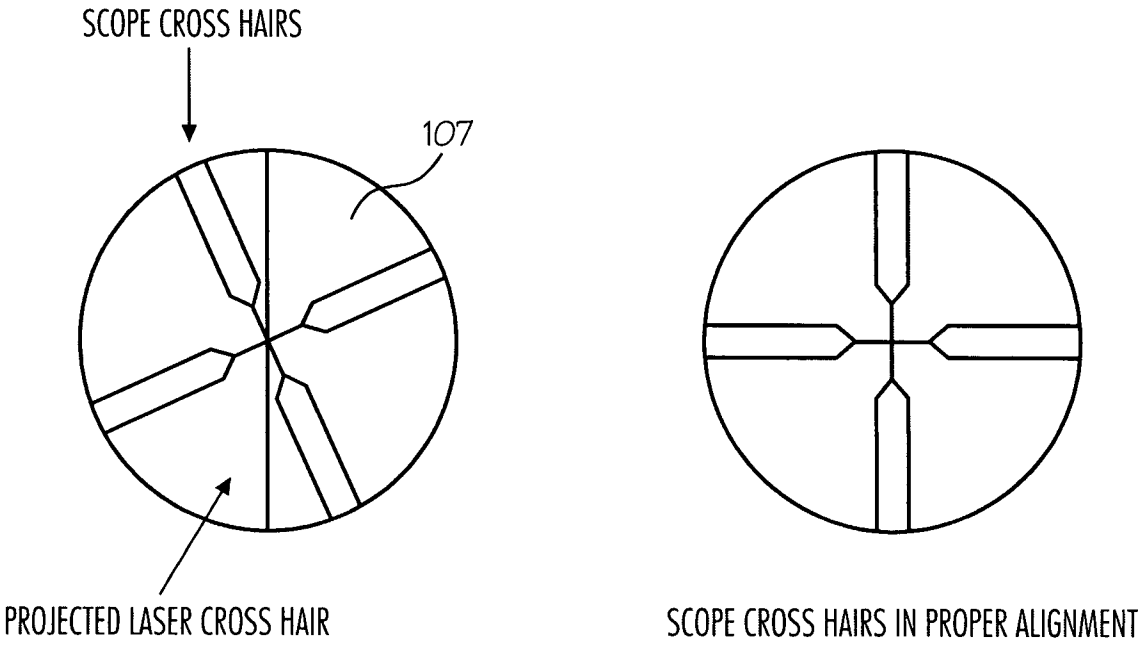
FIG. 7 depicts a view of a vertical reference beam from an optical scope.

FIG. 7 depicts a view of a vertical reference beam from an optical scope. Once the level indicator indicates a level state, the cross-hairs of the optical scope may be adjusted to line up with vertical beam 107.

Figure 8:
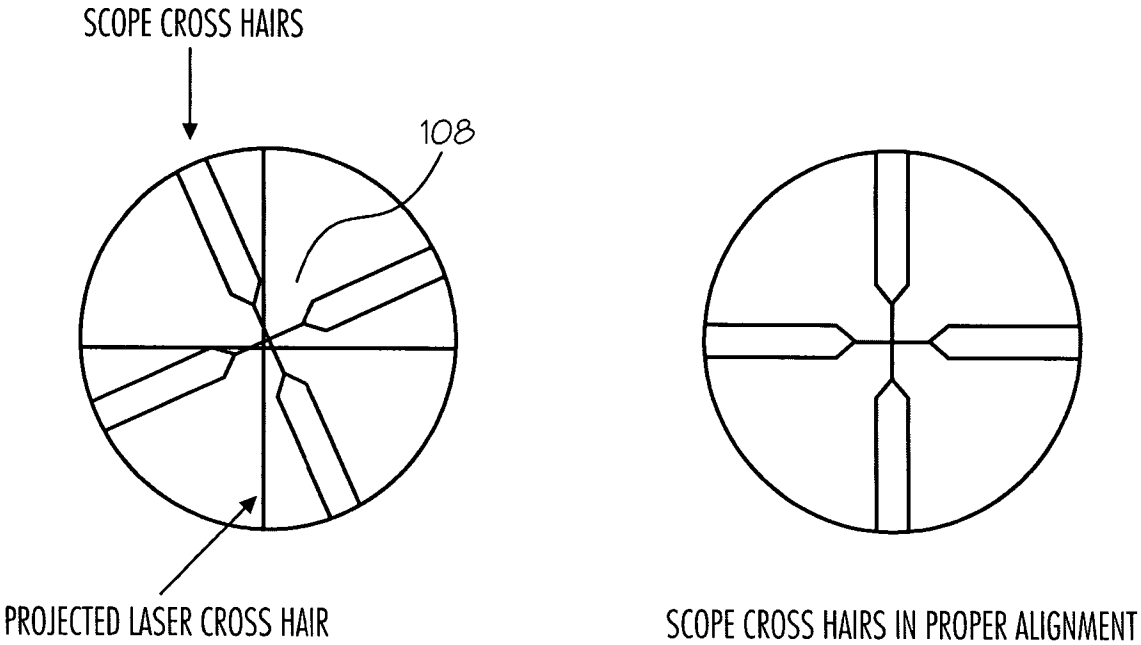
FIG. 8 depicts a view of a cross-hair reference beam from an optical scope.

FIG. 8 depicts a view of a cross-hair reference beam from an optical scope. Once the level indicator indicates a level state, the cross-hairs of the optical scope may be adjusted to line up with cross-hair beam 108.

Figure 9:
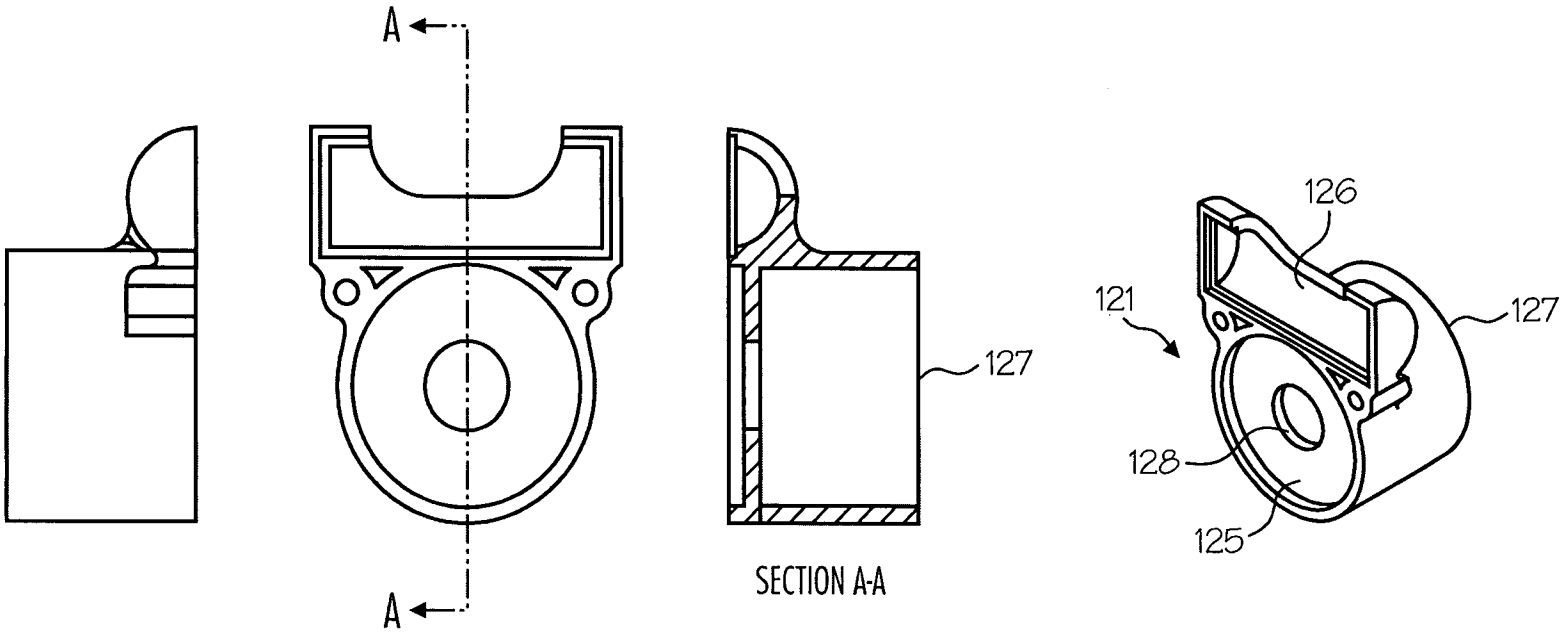
FIG. 9 depicts the rear portion of the housing for the reference beam lens and level indicator according to one embodiment of the invention.

FIG. 9 depicts the rear portion of one embodiment of housing 120. Rear housing 121 of housing 120 includes a generally circular base section 127 that is constructed to fit over the end of light generation device 110. Circular base section 127 may be of any size suitable for attaching to a light generation device. Rear housing 121 also includes lens housing 125 and level housing 126. Lens housing 125 and level housing 126 may be of any size and shape suitable for containing a reference beam lens and level indicator. Light from a light generation device is projected through hole 128 and through the lens.

Figure 10:
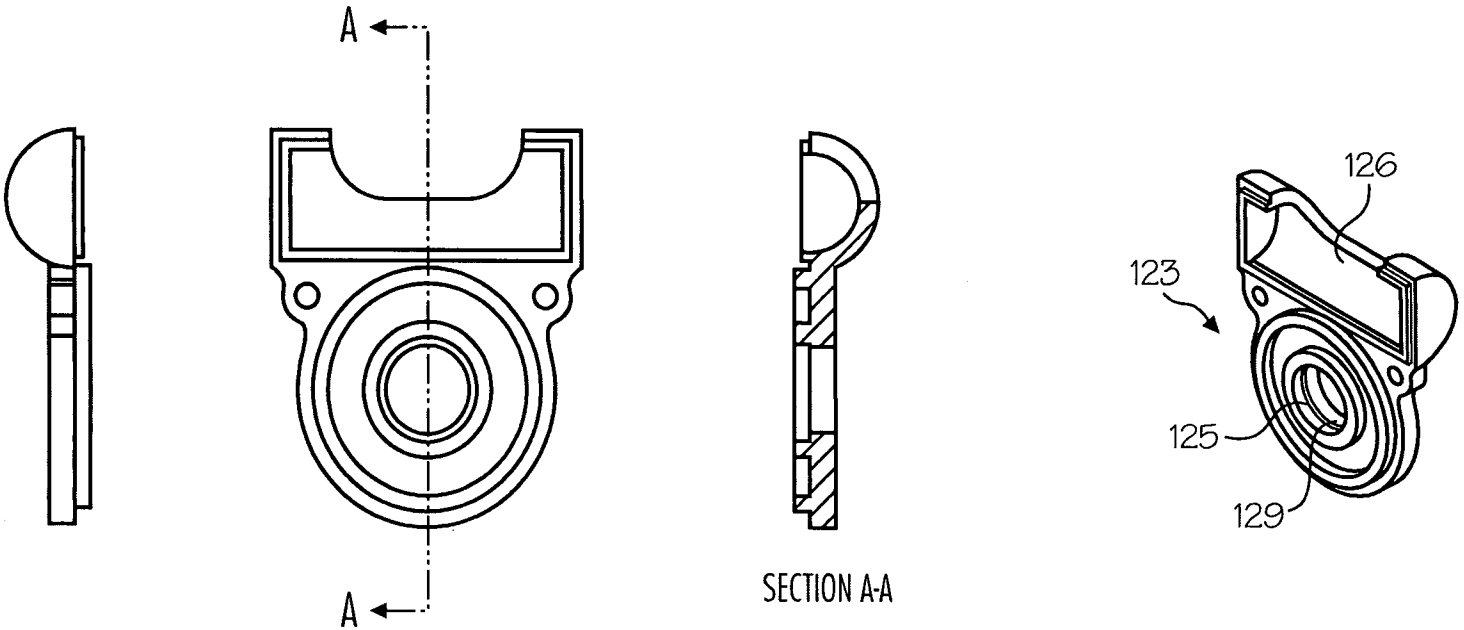
FIG. 10 depicts the front portion of the housing for the reference beam lens and level indicator according to one embodiment of the invention.

FIG. 10 depicts the front portion of housing 120. Front housing 123 also includes a lens housing 125 and level housing 126. Front housing 123 and rear housing 121 are secured together so that the reference beam lens and level indicator are secured within housing 120. Any suitable method may be used to secure front housing 123 to rear housing 121. Front housing 123 also includes hole 129 through which the generated reference beam passes. Lens housing 125 and level housing 126 are constructed such that a reference beam generated from light passing through the reference beam lens is level when a level indicator contained within the level housing indicates a level state.

Figure 11:
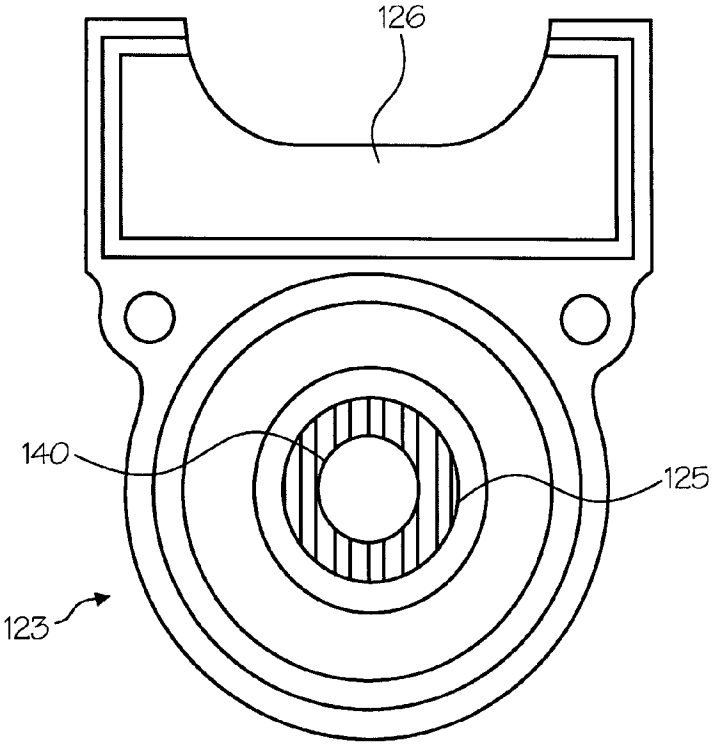
FIG. 11 depicts an end view of the front portion of the housing including the guide for reference beam lens insertion according to one embodiment of the invention.
Figure 12:
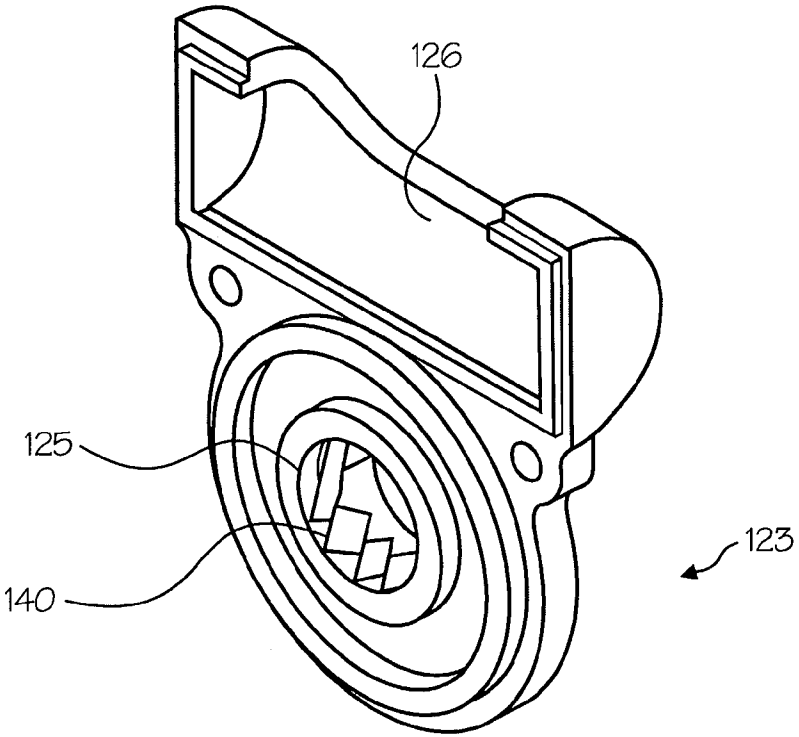
FIG. 12 depicts an isometric view of the front portion of the housing including the guide for reference beam lens insertion according to one embodiment of the invention.

FIG. 11 depicts an end view of the front housing. As seen in FIG. 11, front housing 123 may also include a guide 140 for aiding reference beam lens insertion. Guide 140 is constructed so that its physical features correspond to physical features of the lens. This allows for a more repeatable and accurate insertion of the reference beam lens so that a reference beam produced by the reference beam lens is level when the level indicator indicates a level state. As shown in FIGS. 11 and 12, guide 140 may consist of grooves (e.g., angular vertical-grooves). These grooves mate with grooves on the reference beam lens. Typically, angular vertical-grooves are found on horizontal line-generating lenses. However, the shape of guide 140 is not limited to angular vertical-grooves, but may be any shape or size structure that holds the reference beam lens in a desired alignment when inserted into the housing.

Other embodiments of the invention will be apparent to those skilled in the art from consideration of the specification and embodiments disclosed herein. Thus, the specification and examples are exemplary only, with the true scope and spirit of the invention set forth in the following claims and legal equivalents thereof.

What is claimed is:

1. An apparatus for aiding in the alignment of a scope of a firearm, the apparatus comprising:

a light generation device attachable to the firearm, the light generation device for generating a reference beam; and a level indicator, wherein the reference beam is level with respect to a horizontal plane when the level indicator indicates a level state.

2. The apparatus of claim 1 wherein the reference beam is a line-shaped beam.

3. The apparatus of claim 1 wherein the reference beam comprises a plurality of line-shaped beams.

4. The apparatus of claim 1 wherein the reference beam comprises a series of dots that taken together form a line.

5. The apparatus of claim 1 wherein the reference beam comprises a series of dashes that taken together from a line.

6. The apparatus of claim 1 wherein the light generation device comprises a laser.

7. The apparatus of claim 6 wherein the laser is a solid-state laser module.

8. The apparatus of claim 1 wherein the light generation device fits into the bore of the firearm.

9. The apparatus of claim 8 wherein the light generation device further comprises:

a bore connector having a first end and a second end, wherein the first end fits into the bore of the firearm; and a light generator for generating the reference beam, the light generator being attached to the second end of the bore connector.

10. The apparatus of claim 9 wherein the first end of the bore connector is also attachable to the firearm by inserting the first end into a bore adapter contained within the bore of the firearm.

11. The apparatus of claim 9 wherein the first end of the bore connector is also attachable to the firearm by insertion into a bore connector receptacle attached to the firearm.

12. The apparatus of claim 1 wherein the light generation device further includes a reference beam lens, wherein the reference beam is generated by passing light through the reference beam lens.

13. The apparatus of claim 12 wherein the level indicator is mounted on the reference beam lens.

14. The apparatus of claim 12 wherein the reference beam lens is a line-generating lens.

15. The apparatus of claim 1 wherein the level indicator is a bubble-type level.

16. The apparatus of claim 1 wherein the light generation device generates a horizontal reference beam when level.

17. The apparatus of claim 1 wherein the light generation device generates a vertical reference beam when level.

18. The apparatus of claim 1 wherein the light generation device generates a cross-hair reference beam.

19. The apparatus of claim 1, wherein the light generation device includes a bore connector, wherein the light generation device is attachable to the firearm by inserting the bore connector in a bore of the firearm.

20. A system for creating at least one level reference beam, the system comprising:

a housing configured to attach to a provided light generation device, the light generation device attachable to a provided firearm;

a lens contained within the housing that creates at least one reference beam when a light from the light generation device is passed through the lens, the reference beam being adjustable; and a level indicator mounted on the housing, wherein the at least one reference beam is level with respect to a horizontal plane when the level indicator indicates a level state.

21. The system of claim 20 wherein the housing includes a structure for aligning the lens such that the reference beam will be level when the level indicator indicates a level state.

22. The system of claim 21 wherein the structure for aligning the lens is one or more grooves in the housing that align with one or more grooves formed in the lens.

23. The system of claim 21 wherein the structure for aligning the lens is a frame in which the lens fits.

24. The system of claim 20 wherein the level indicator is a bubble-type level.

25. The system of claim 20 wherein the lens creates one reference beam.

26. The system of claim 20 wherein the lens generates a horizontal reference beam when level.

27. The system of claim 20 wherein the lens generates a vertical reference beam when level.

28. The system of claim 20 wherein the lens generates a cross-hair reference beam.

29. The system of claim 20, wherein the light generation device includes a bore connector, wherein the light generation device is attachable to the firearm by inserting the bore connector in a bore of the firearm.

* * * * *